United States Patent [19]

Wiig

[11] Patent Number: 4,793,464

[45] Date of Patent: Dec. 27, 1988

[54] APPARATUS FOR INVERTING STRIPS OF SHEET MATERIAL

[75] Inventor: Chester M. Wiig, Lincolnwood, Ill.

[73] Assignee: F. J. Littell Machine Company, Chicago, Ill.

[21] Appl. No.: 474,832

[22] Filed: Mar. 14, 1983

[51] Int. Cl.[4] ..... B65G 29/00

[52] U.S. Cl. ..... 198/404; 198/690.1; 271/65; 271/277; 414/759

[58] Field of Search ..... 198/404, 410, 402, 403, 198/690, 381; 271/186, 65, D9, 275, 276, 277; 414/759, 774, 783, 758, 757

[56] References Cited

U.S. PATENT DOCUMENTS

| | | | |
|---|---|---|---|
| 363,883 | 5/1887 | Beckler | 271/65 |
| 2,365,678 | 12/1944 | Butler | 198/690 |
| 3,315,958 | 4/1967 | Geeson | 271/65 |
| 3,567,005 | 3/1971 | Johnson | 198/404 |
| 3,795,301 | 3/1974 | Sugitani | 198/404 |

*Primary Examiner*—Leslie J. Paperner
*Assistant Examiner*—Cheryl L. Gastineau
*Attorney, Agent, or Firm*—Willian Brinks Olds Hofer Gilson & Lione Ltd.

[57] ABSTRACT

An inverter apparatus for strips of sheet material which are affected by a magnetic field. The apparatus includes a pair of parallel drums which rotate in opposite directions immediately adjacent each other. Mounted within the drums in prescribed and fixed relationship are permanent magnets. A strip adheres to the first drum under the effects of the magnets within and rotates with that drum until it comes between the two drums. At that point the strip enters the field of the magnets in the second drum and departs the field of those in the first whereby it adheres to the second drum. The strip rotates with the second drum until it departs the field of the magnets therein, whereupon the strip drops off the drum in inverted relationship.

6 Claims, 3 Drawing Sheets

Fig. 1.
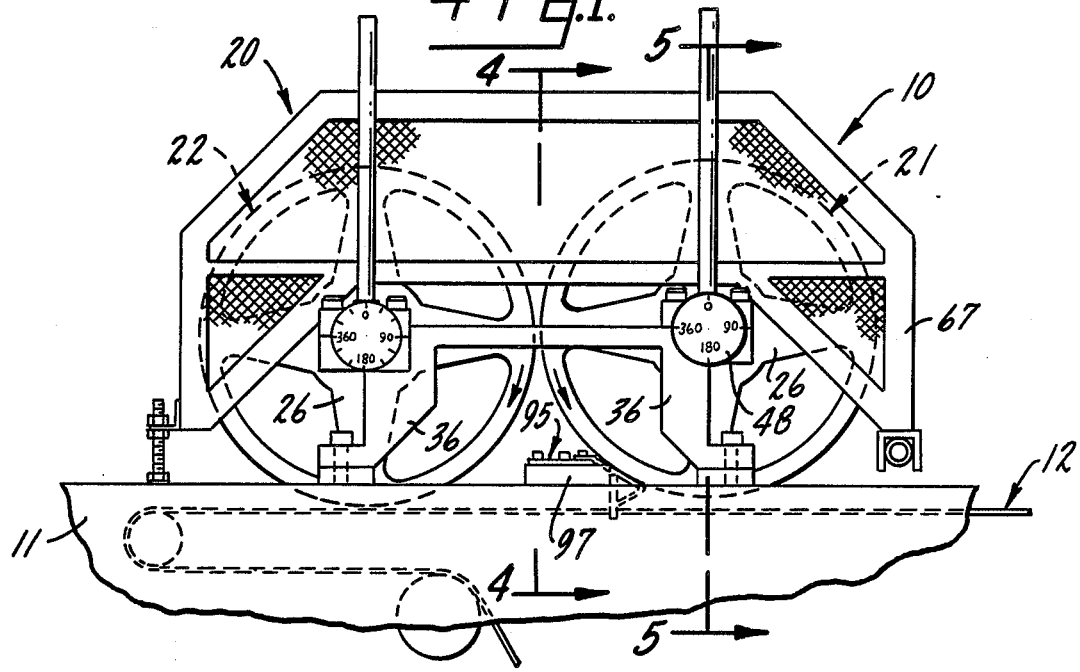
Fig. 3.
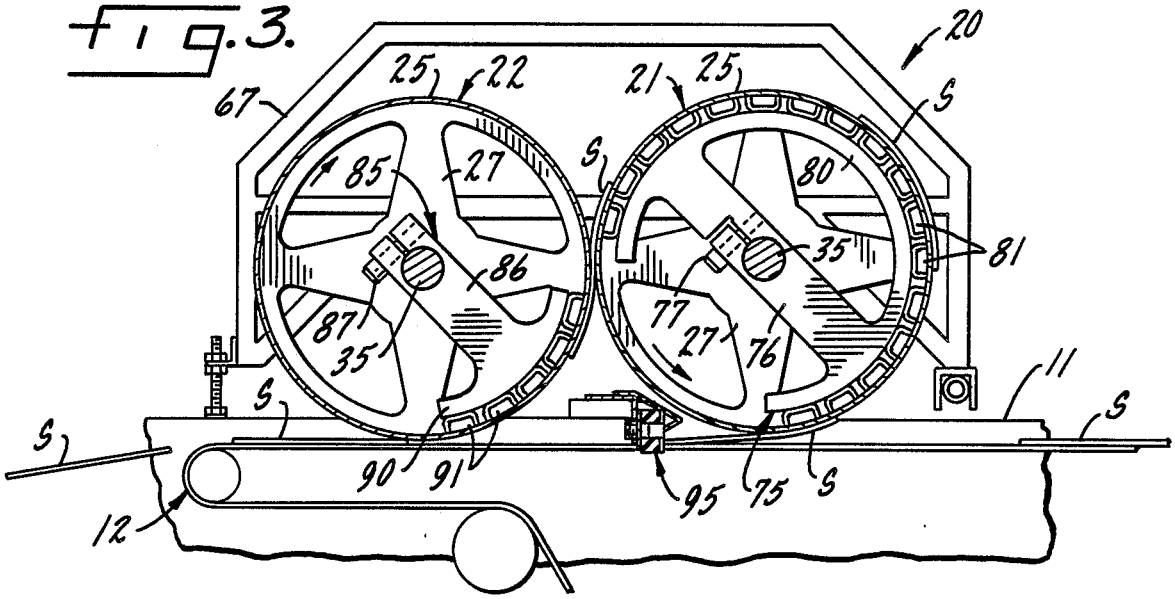
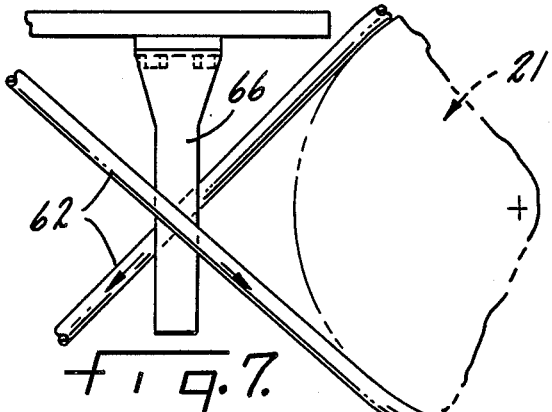
Fig. 7.
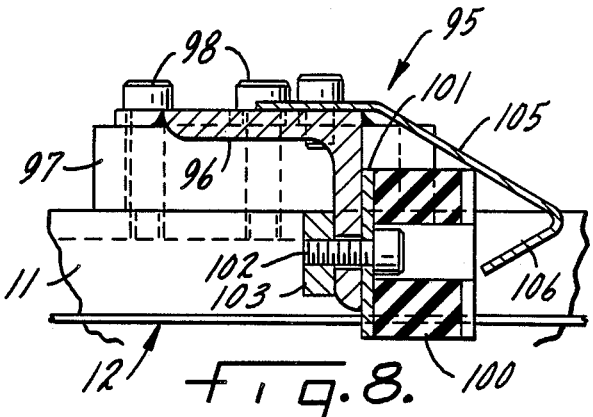
Fig. 8.

APPARATUS FOR INVERTING STRIPS OF SHEET MATERIAL

FIELD OF THE INVENTION

This invention relates generally to apparatus for inverting, i.e., turning over, a strip of sheet material after the strip has been cut from a coil, for example. It relates particularly to apparatus which receives, in rapid succession, strips of sheet metal lying on one side, and turns them over or inverts them so that each then lies on its other side.

BACKGROUND OF THE INVENTION

A step in the manufacture of metal cans involves cutting sheet metal strips. Can components, including tops and bottoms, are then formed from the metal strips. Machines of known construction, such as those manufactured by F. J. Littell Machine Co., assignee of the present invention, are utilized to convert coils of tin plate, alumium or tin-free steel or the like into strips.

The strips from which the can tops and bottoms are formed are known as straight cut or "scroll" cut strips. The term "scroll" comes from the irregular edge configuration cut into strips in one process as they are sheared to assure maximum metal utilization in each strip as the can tops or bottoms are punched from the strip by a punch press.

In the production process, the strips must be inverted before they are stacked on pallets for transport to the can-forming lines. As each strip is cut it is ejected from the cutting operation lying on one side. The can top forming machinery, because of characteristics of the finished product desired, must receive each strip in inverted relationship, i.e., with the strip lying on its other side. A strip inverter is conventionally employed in the context of a larger strip stacker to flip each strip from one side onto its other side before it is stacked on a pallet, for example, for ultimate delivery to the can forming operation.

As with virtually any production process, the speed at which strips can be fabricated, inverted and stacked affects the cost of the strip. It has been the experience of the F. J. Littell Machine Co. that the strip inverting process is the limiting factor. With known strip inverting apparatus a maximum of approximately one hundred strips can be inverted per minute.

SUMMARY OF THE INVENTION

An object of the present invention is to provide an improved apparatus for inverting strips of sheet material. Another object is to provide an improved apparatus for receiving sheared or cut strips of sheet metal lying on one side and turning them over or inverting them so that each strip then lies on its other side. Still another object is to provide an improved apparatus for inverting strips of sheet metal wherein the apparatus can handle more than twice as many strips as presently handled by conventional inverting apparatus.

The foregoing and other objects are realized by providing an inverter apparatus for inverting strips of magnetically attracted sheet material as they are transported from a cutting operation to a pallet for stacking by a conventional stacker. The inverter apparatus includes first and second turnover drums mounted parallel to each other above strip conveyor means. The drums are rotated in opposite directions. Fixed against rotation within each of the drums in prescribed positions are permanent magnets.

In operation, a strip travels to a point underneath the first drum on the strip conveyor where it strikes bumper means, causing it to rebound and jump upwardly against the first drum. The magnets within this drum cause the strip to adhere to the drum as it rotates whereby the strip is carried with the drum in its travel until the strip reaches a point between the two drums. At this point the magnets within the second drum cause the strip to adhere to it at the same time that the strip departs the magnetic field of the magnets in the first drum.

The strip now is carried by the second drum downwardly to a point immediately above the strip conveyor again. At this point the strip passes out of the field of the magnets in the second drum and drops onto the conveyor. It has been inverted in its travel around the two drums.

BRIEF DESCRIPTION OF THE DRAWINGS

The invention, including additional objects and advantages thereof, is illustrated more or less diagrammatically in the drawings, in which:

FIG. 1 is a side elevational view of an improved apparatus for inverting strips of sheet material;

FIG. 3 is a view taken along line 3—3 of FIG. 2;

FIG. 7 is an enlarged view taken along line 7—7 of FIG. 2, with parts removed; and FIG. 8 is an enlarged illustration of the strip bumper seen between the turnover drums in FIG. 3.

DESCRIPTION OF THE PREFERRED EMBODIMENT

Figure 2:
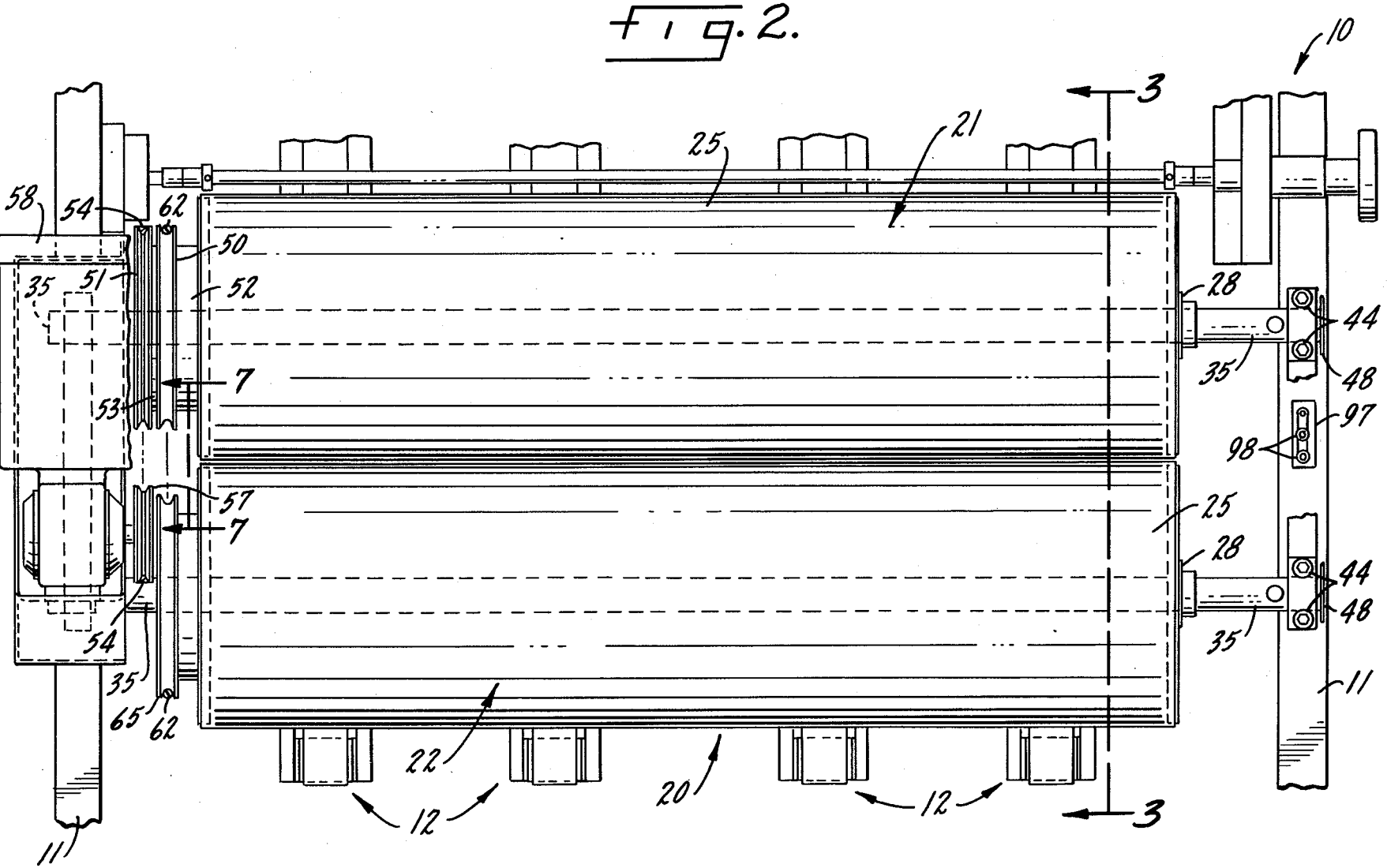
FIG. 2 is a top plan view of the apparatus illustrated in FIG. 1.

Referring now to the drawings, and particularly to FIGS. 1 and 2, a portion of a strip stacker is illustrated generally at 10. The stacker itself is generally conventional, and is one of the type which is manufactured by the F. J. Littell Machine Co. of Chicago, Ill.

The illustrated portion of this stacker 10 includes a frame 11 on which parallel (4) strip conveyors 12 are mounted. The strip conveyors 12 are designed to take strips of tin plated sheet metal (see FIG. 3), for example, which have been cut from a roll at a conventional shear (not shown) and convey them to a stacking area (not shown).

Between the locations in the stacker 10 where strips are received from the shear and where the strips are ultimately stacked on pallets, the strips are inverted by an inverter apparatus 20 embodying features of the present invention. The inverter apparatus 20 sequentially receives individual strips S lying on one side. As each strip S enters the inverter apparatus 20 it is gripped by the apparatus and inverted, according to the invention, to be discharged onto the conveyor 12 lying on its other side.

The inverter apparatus 20 includes first and second turnover drums 21 and 22, each 12" in diameter, mounted parallel to each other in horizotal relationship above the strip conveyors 12. The drums 21 and 22 are substantially identical and, accordingly, a description of the drum 21 will contribute greatly to an understanding of the construction of the drum 22. Corresponding reference numerals are used where corresponding components are involved. Where a distinction between components is in order for reasons which will hereinafter be discussed, different reference numerals are employed.

Figure 5:
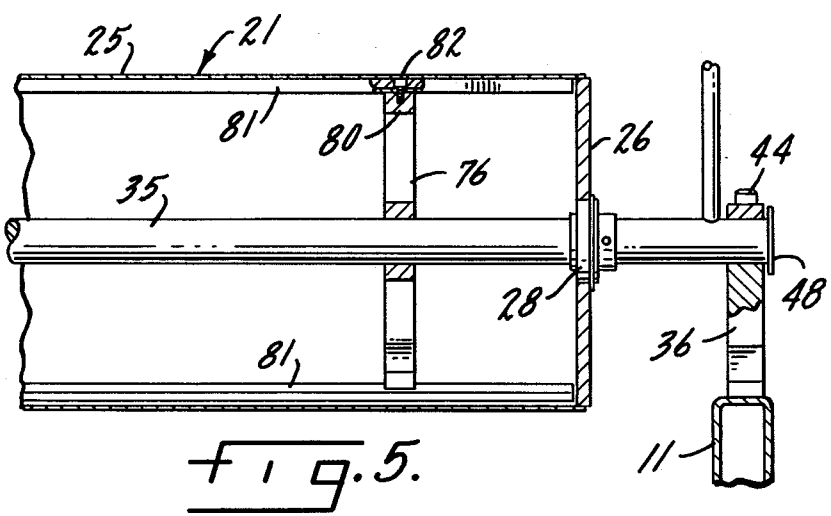
FIG. 5 is a view taken along line 5—5 of FIG. 1, with parts removed.
Figure 4:
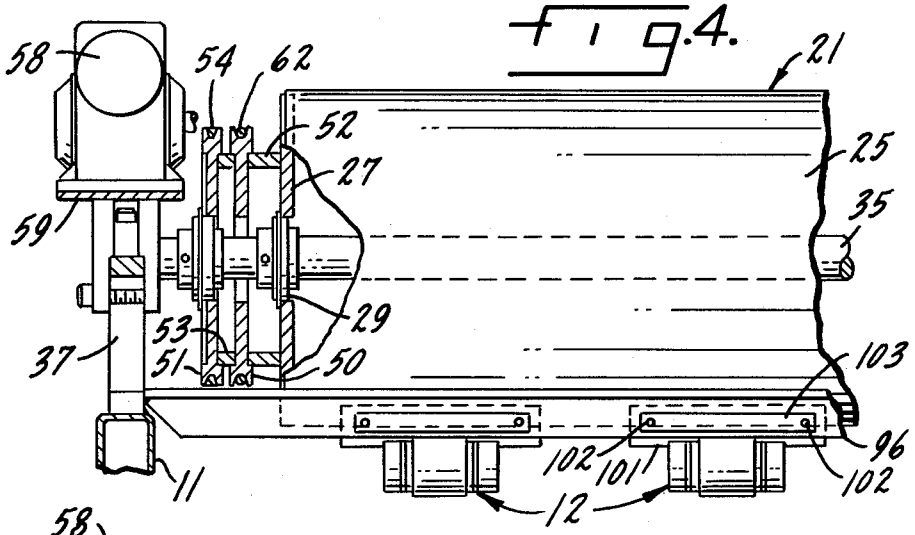
FIG. 4 is a view taken along line 4—4 of FIG. 1, with parts removed.
Figure 6:
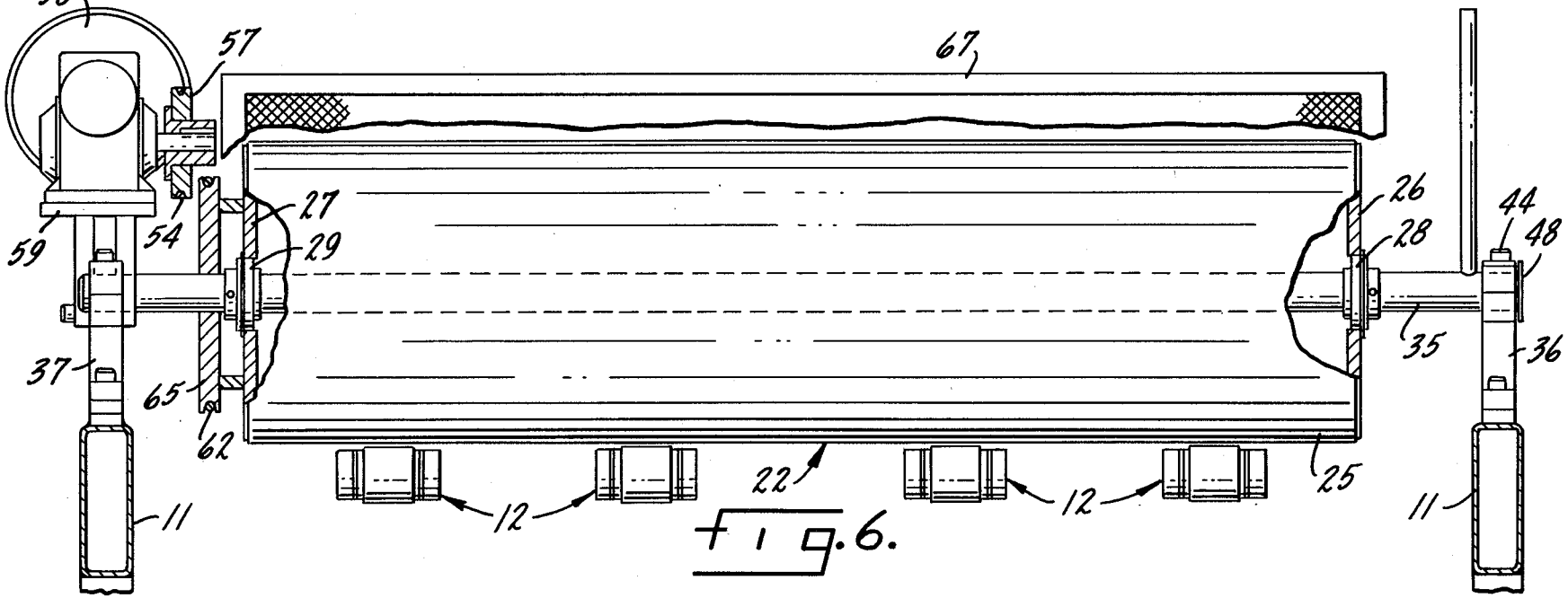
FIG. 6 is a view similar to FIG. 4 illustrating the number two turnover drum.

As best seen in FIGS. 4 and 5, the drum 21 includes a cylinder 25 of sixteen gauge stainless steel sheet. The cylinder 25 is mounted, at its opposite ends, on circular steel webs 26 and 27. The webs 26 and 27 have, in turn, journal bearings 28 and 29, respectively, mounted at their centers, i.e., on the axis of the drum 21.

The journal bearings 28 and 29 receive a fixed mounting shaft 35 which extends over the top of the strip conveyor frame 11 above the conveyors 12. The shaft 35 is non-rotatably, but adjustably, supported from the frame 11 at its opposite ends. A vertical support post 36 mounts the shaft 35 at one end. At its opposite end the shaft 35 is supported on top of a vertical mounting plate 37. Clamp screws 44 lock the shaft 35 against rotation or permit it to be rotated about its axis for angular adjustment. A dial 48 bearing a 360° adjustment read-out is provided on one end of the shaft 35 to facilitate this angular adjustment, for reasons which will hereinafter be discussed.

As illustrated in FIGS. 2 and 4, the circular plate 27 at one end of the drum 21 has a pair of pulleys 50 and 51 affixed to it on the axis of the drum. The inner pulley 50 is mounted on the web 27 with a mounting ring 52 and the outer pulley 51 is mounted on the inner pulley on a similar but smaller mounting ring 53.

The outer pulley 51 is connected by a conventional Vee belt 54 to the small drive pulley 57 of an electric drive motor 58. The electric drive motor 58 is, in turn, mounted through its base plate 59, on the vertical mounting plate 37. Operation of the motor 58 is effective to rotate the pulley 51 which, in turn, rotates the drum 21. As seen in FIG. 1, the drum 21 is caused to rotate in a counterclockwise direction by the operation of the motor 58, the pulleys 57, 51, and the Vee belt 54.

The inner pulley 50 is connected by a conventional round belt 62 to a corresponding pulley 65 mounted on the web 27 of the drum 22. The belt 62 is crossed, as illustrated in FIG. 7, so that it is effective to rotate the drum 22 in a clockwise direction, however. As a result, operation of the motor is effective to drive the turnover drum 21 in a counterclockwise direction and, at the same time, drive the adjacent turnover drum 22 in a clockwise direction, albeit at identical speeds. A friction reducing belt spacer is provided at 66, as seen in FIG. 7, to prevent debilitating contact between the belt runs. The spacer 66 is mounted on the frame of the hood 67 in a conventional manner.

Mounted within the drum 21, and fixed to its shaft 35, is a semi-cylindrical permanent magnet assembly 75, best seen in FIGS. 3 and 5. The magnet assembly 75 includes a pair of identical mounting cages 76 (only one shown) fixed to the shaft 35 by screw clamps 77. The cages 76 are spaced on the shaft 35 so as to be adjacent its opposite ends but within the drum 21.

Each cage 76 has a 260°, semi-circular mounting segment 80 forming its outer periphery. Extending between the cages 76, and along the entire length of the drum 21, are seventeen ceramic bar magnets 81, fastened to corresponding segments 80 with screws 82. In the illustrated embodiment each magnet's dimensions are $1\frac{3}{8}'' \times 9/16'' \times 40''$. The radius of the segment 80 and the thickness of the magnets 81 are such that the outer surfaces of these magnets are spaced but a fraction of an inch from the inner surface of the steel cylinder 25; in the neighborhood of 1/16" has been found most effective in practice.

Referring specifically to FIG. 3, the magnets 81 are disposed between the 275° point and the 85° point on a compass, as will be recognized. This arrangement, peculiar to the invention, serves the strip inversion operation in a manner hereinafter discussed.

Mounted within the drum 22, and fixed to its shaft 35, is a semi-cylindrical permanent magnet assembly 85, best seen in FIG. 3. The magnet assembly 85 includes a pair of identical mounting cages 86 (only one shown) fixed to the shaft 35 by screw clamps 87. The cages 86 are spaced on the shaft 35 so as to be adjacent its opposite ends but within the drum 22.

Each cage 86 has an 80°, semi-circular mounting segment 90 forming its outer periphery. Extending between the cages 86 and along the entire length of the drum 22, are five ceramic bar magnets 91, also fastened to corresponding segments 90 with screws. Each magnet's dimensions are, again, $1\frac{3}{8}'' \times 9/16'' \times 40''$. The radius of the segments 90 and the thickness of the magnets 91 are such that the outer surfaces of these magnets are also spaced approximately 1/16" from the inner surface of the steel cylinder 25.

As further seen in FIG. 3, the cylinder 25 on the drum 21 is spaced a greater distance above the conveyors 12 than the cylinder 25 on the drum 22. The drum 21 spacing in question is 0.56" in practice, i.e., where the strips S are 0.006"–0.014" thick. In contrast, the drum 22 spacing in question is 0.31". This spacing variance is achieved by vertical adjustment of the respective shafts 35 on their fixed mountings.

Mounted over each of the four strip conveyors 12, beneath the 180°–270° quadrant of the drum 21, is a bumper assembly 95, as seen in FIG. 3. They are identical so only one is described in detail. Reference is made to FIG. 8 for an enlarged representation.

Each bumper assembly 95 actually includes an angle-iron member 96 extending between the frame 11 side rails. The angle-iron member 96 is suitably affixed to these rails on mounting blocks 97 with bolts 98.

Each bumper assembly 95 comprises a rubber block 100 fastened to a plate 101 by a suitable adhesive. The plate 101 is held to the member 96 with bolts 102 which pass through holes in the member 96 and are fastened into a back-up plate 103. Each block 100 and plate 101 define an inverted U (shape) and overlies a corresponding conveyor belt so that the belt passes between depending legs of the U.

Immediately above each block 100 is a deflector plate 15. The plate 105 is also fastened to the member 96, as illustrated in FIG. 8. Each plate 105 has a downwardly inclined lip 106 at its free end positioned to deflect strips S in a manner hereinafter discussed. Each lip 106 terminates at a point approximately 0.38" above the corresponding conveyor 12.

In operation, the conveyor 12 belts are driven at 300–350 fpm. The drums 21 and 22 are rotated at the same speed in the manner hereinbefore discussed. Scroll strips S are carried by the conveyors 12, toward the bumper blocks 100, as seen in FIG. 3.

As each strip S engages the bumper blocks 100 at relatively high speed it tends to bounce back and upwardly. The leading edge of each strip S is limited in the distance it can move upwardly by the deflector plates 105. The trailing edge of each strip S adheres to the rotating cylinder 25 of the drum 21, attracted by the magnets within the drum at the 175° radial of the drum.

Held on the cylinder 25 of the drum 21 by the magnet field generated by the magnets 81, the strip S rotates with the cylinder 25 in a counter-clockwise direction until it passes the 275° radial of the drum 21. At this point the magnet assembly 75 ends and the magnetic field weakens and disappears. The sheet S passes down between the drums 21 and 22, which are rotating in opposite directions at the same speed.

As the strip S emerges from between the drums 21 and 22, which are spaced but 0.031" apart at their closest point, the magnets 91 of the magnet assembly 85 in the drum 22 take over. They generate a magnetic field which attracts the leading edge of the strip S and cause it to adhere to the clockwise rotating drum 22 through what amounts to that drums 95°–175° quadrant.

When the strip S reaches the conveyors 12 again as seen in FIG. 3, it passes out from under the magnetic field in the drum 22. The strip S is, in effect, released by the drum. The conveyors 12 carry it, inverted from its input position to a stacking operation (not shown).

The carrying force in each drum is provided by the corresponding stationary magnet assembly 75 or 85, of course. To adjust the effects of these forces angularly on corresponding shafts 35, the dials 48 are provided. Each shaft 35 can be rotated to make minute magnet position adjustments, using the dials 48 as control references.

Employing the apparatus of the invention more than 200 strips can be inverted per minute. The apparatus operates quietly and utilizes minimal power since no reciprocating or oscillating mass movements are involved. The apparatus can be installed and removed easily from existing conveyor-stacker equipment.

While the embodiment described herein is at present considered to be preferred, it is understood that various modifications and improvements may be made therein, and it is intended to cover in the appended claims all such modifications and improvements as fall within the true spirit and scope of the invention.

I claim:

1. An apparatus for inverting strips of sheet metal comprising:

(a) means for sequentially feeding said strips of metal;

(b) a first rotating drum adjacent said feeding means and having first means therein for establishing a magnetic field on a portion of the surface of that drum;

(c) a second rotating drum adjacent said feeding means and having a portion closely adjacent a portion of said first drum, said second drum having second means therein for establishing a magnetic field on a portion of the surface of that drum;

(d) means for rotating said drums in opposite directions; and (e) said strips of sheet metal on said feeding means moving into engagement with the surface of said first drum whereby said strips are attracted by the magnetic field associated with said first drum and removed from said feeding means and rotated with said first drum until they enter the magnetic field associated with said second drum, whereby the strips are attracted by the latter magnetic field and transferred from said first drum directly to said second drum at said closely adjacent portions and rotated with said second drum until they pass the latter magnetic field whereby the strips depart said second drum and are delivered back to the feeding means in inverted relationship.

2. The apparatus of claim 1 further characterized in that:

(a) said magnetic fields remain stationary while said drums rotate.

3. The apparatus of claim 2 further characterized in that:

(a) each of said drums comprise a hollow cylinder;

(b) each of said magnetic fields being generated by a magnet assembly mounted within a corresponding drum.

4. An apparatus for inverting strips of sheet metal comprising:

(a) means for feeding said strips of metal;

(b) a pair of rotating drums having closely adjacent portions;

(c) means for establishing a magnetic field on the surfaces of said drums; and (d) said feeding means feeding said strips of sheet metal into engagement with the surface of one of said drums whereby said strips rotate with said one drum, are transferred directly to the other of said drums at said closely adjacent portions, and are delivered back to said feeding means in inverted fashion.

5. The apparatus of claim 1 further characterized that:

(a) said feeding means includes a moving conveyor operable to deliver said strips to a point underneath the first drum; and (b) stationary bumper means adjacent said conveyor causing said strips to rebound and jump upwardly against said first drum.

6. The apparatus of claim 1 further characterized that:

(a) said magnetic field associated with the first drum extends from a point adjacent said feeding means to a point adjacent the second drum in the direction of rotation of said first drum; and (b) said magnetic field associated with the second drum extends from a point adjacent said first drum to a point adjacent the feeding means in the direction of rotation of said second drum.

* * * * *